US009200755B1

(12) United States Patent
Corey

(10) Patent No.: US 9,200,755 B1
(45) Date of Patent: Dec. 1, 2015

(54) LASER LIGHT SOCKET BULB

(71) Applicant: Jim Breen, Chandler, AZ (US)

(72) Inventor: Carter Corey, Chandler, AZ (US)

( * ) Notice: Subject to any disclaimer, the term of this patent is extended or adjusted under 35 U.S.C. 154(b) by 0 days.

(21) Appl. No.: 14/063,551

(22) Filed: Nov. 6, 2013

Related U.S. Application Data

(60) Provisional application No. 61/718,608, filed on Oct. 25, 2012, provisional application No. 61/770,089, filed on Feb. 27, 2013.

(51) Int. Cl.
*F21V 31/00* (2006.01)
*F21K 99/00* (2010.01)

(52) U.S. Cl.
CPC ..... *F21K 9/10* (2013.01)

(58) Field of Classification Search
CPC ... F21Y 2101/025; F21K 9/13; F21K 9/1355; F21K 9/1375; F21S 10/00; F21W 2131/406; H01S 5/005
See application file for complete search history.

(56) References Cited

U.S. PATENT DOCUMENTS

| | | | | |
|---|---|---|---|---|
| 2010/0118536 | A1* | 5/2010 | Johnson | 362/259 |
| 2010/0296536 | A1* | 11/2010 | Tao | 372/36 |
| 2011/0089838 | A1* | 4/2011 | Pickard et al. | 315/113 |
| 2012/0300455 | A1* | 11/2012 | Breidenassel et al. | 362/235 |
| 2013/0229813 | A1* | 9/2013 | Matsuda et al. | 362/382 |

* cited by examiner

*Primary Examiner* — Tracie Y Green
(74) *Attorney, Agent, or Firm* — Paul B. Heynssens Attorney at Law PLC

(57) ABSTRACT

A laser light configured to be socket compatible with an incandescent bulb. The laser light bulb fits into a standard base for a number of standard incandescent bulbs. The laser light bulb receives AC power from the light socket, and has an overall shape or envelope similar to the incandescent bulb being replaced. Internal to the envelope are electronics needed to power the laser, and the laser itself.

20 Claims, 10 Drawing Sheets

Housing Assembly
220

Laser Light Socket Bulb
310

End View
Laser Light Socket Bulb
510

Laser Light Socket Bulb with Removable Cap Removed
608

Laser Light Socket Bulb
810

Laser Light Socket Bulb 810 with Diffraction Accessory 902

Laser Light Socket Bulb Electronics 1002

LASER LIGHT SOCKET BULB

CROSS-REFERENCE TO RELATED APPLICATIONS

This application claims the benefit of U.S. Provisional Patent Application No. 61/718,608 filed Oct. 25, 2012 and U.S. Provisional Patent Application No. 61/770,089 filed Feb. 27, 2013, the contents of which are hereby incorporated by reference.

TECHNICAL FIELD

This description relates generally to lighting and illumination and more specifically to decorative lighting devices.

BACKGROUND

An incandescent light bulb, incandescent lamp, or incandescent light globe is an electric light which produces light with a filament wire, suspended in a near vacuum and heated to a high temperature by an electric current passing through it, until it glows producing light. The hot filament is protected from oxidation with a glass bulb that is evacuated and partially filled with inert gas usually at a pressure lower than the atmosphere. The light bulb filament is supplied with electrical current by feed-through terminals or wires embedded in a glass stem that supports the filament. Most bulbs are made for use in a socket which provides mechanical support and electrical power.

Incandescent bulbs are manufactured in a wide range of sizes, light output, and voltage ratings, typically from 1.5 volts to about 300 volts. They require no external regulating equipment, have low manufacturing cost, and may be powered by either alternating current or direct current. As a result, the incandescent lamp is widely used in household and commercial lighting, for portable lighting such as table lamps, car headlamps, and flashlights, and for decorative and advertising lighting.

Because of their inefficiency, incandescent light bulbs are gradually being replaced in many applications by other types of electric lights, such as fluorescent lamps, compact fluorescent lamps (CFL), cold cathode fluorescent lamps (CCFL), high-intensity discharge lamps, and light-emitting diodes (LEDs). However, one area that has not received attention is improving power efficiency for decorative lighting because the focus of development has often been in improving lighting efficiency, and replacing bulbs used for simple lighting rather than provide efficient decorative lighting. Therefore, it would be advantageous to provide a power efficient decorative light device that utilized existing incandescent bulb sockets.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The present example provides a laser decorative lighting device that is socket compatible with incandescent light bulbs, and is generally of a size envelope that is compatible with conventional incandescent fixtures. A housing contains a socket that brings AC power at line voltage from the standard light fixture to an internal power supply inverter, driver electronics, and a laser device. The housing may also include internal or external devices such as gratings, apertures of various shapes, and the like for providing decorative lighting effects that advantageously utilize coherent light produced by the laser that is disposed in the conventional incandescent light fixture.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present examples may be constructed or utilized. The description sets forth the functions of the examples and the sequence of steps for constructing and operating the examples. However, the same or equivalent functions and sequences may be accomplished by different examples.

The examples below describe a laser light socket bulb. Although the present examples are described and illustrated herein as being implemented in a standard screw base (for example, E10, E14, and E27 Edison screw base or the like) system, the system described is provided as an example and not a limitation. As those skilled in the art will appreciate, the present examples are suitable for application in a variety of different types of types of incandescent light bulb socket systems such as bayonet fittings, push in fittings, or the like.

The laser light socket bulb provides decorative laser lighting effects from a standard light fixture to any object that typically will hinder the light from passing through or otherwise will provide a suitable surface so that the lighting effect may be viewed. An intended use for this laser light socket bulb is typically as a secondary light source, an accent light, decorative lighting or the like. The laser light socket bulb can provide a rapid way to provide the lighting during holidays, special events, and the like by removing the existing incandescent type bulb and simply substituting the laser light socket bulb in its place. No modifications or adaptations need be made to the existing wiring or fixturing. And the original bulb may be replaced at a later time, such as when the holidays have passed.

Figure 1:
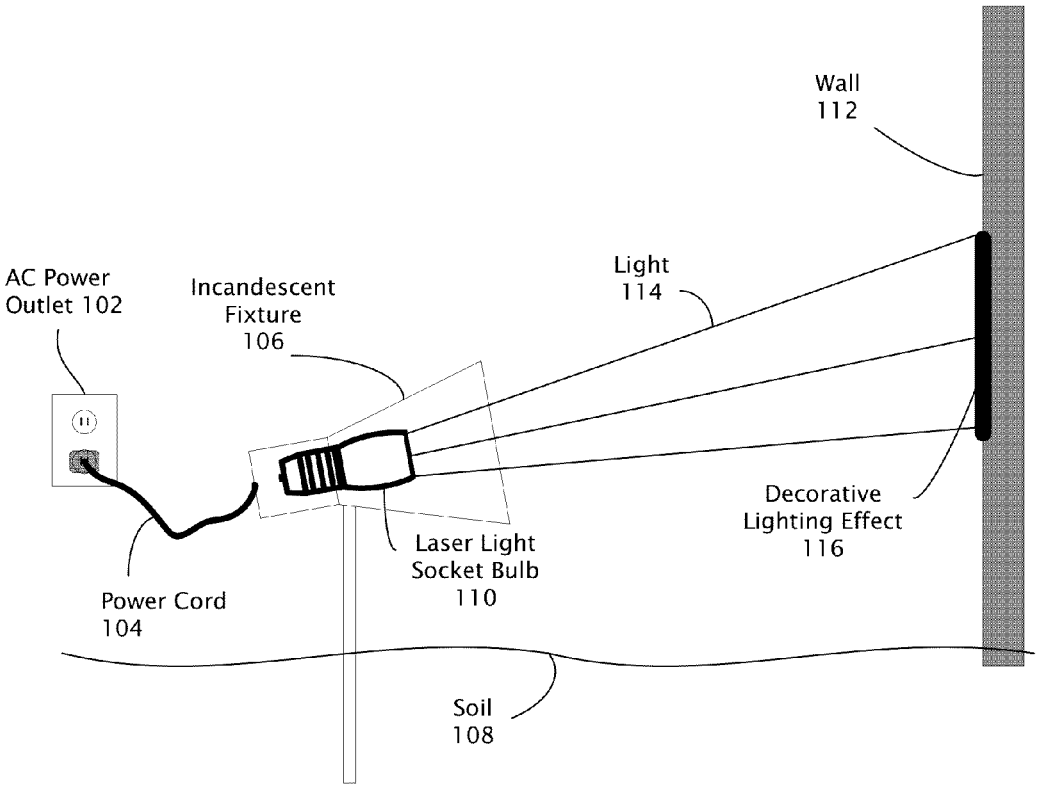
FIG. 1 shows a laser light socket bulb in use in a conventional outdoor incandescent light fixture.

FIG. 1 shows a laser light socket bulb 110 in use in a conventional outdoor incandescent light fixture. The laser light socket bulb 110 emits coherent laser light of one or more colors. The light can be processed by removable or adjustable accessories to produce varied shapes and effects on light passing through the accessory. In alternative examples it is anticipated that electronics may steer the laser beam output to produce additional effects and also that the one or more lasers may be gated on and off in a programmed sequence to produce various patterns and effects.

The laser light socket bulb 110 may be used as an outdoor decorative light projecting a decorative lighting effect onto a surface, such as a wall or other object 112. The laser light socket bulb 110 is installed in a conventional incandescent light fixture 106 mounted here shown as mounted in the ground 108. The fixture 106 is electrically connected to an A/C power outlet 102 by a power cord 104. When powered, the laser light socket bulb 110 produces light 114, which is projected onto an object that hinders light transmittance, such as a wall of a dwelling 112. Equivilently the light may be shown on trees, shrubberies, and other irregular surfaces. The laser light socket bulb 110 produces decorative lighting effects 116 onto the wall 112.

The laser light socket bulb 110 is a screw in, laser lighting device for the purpose of decorative lighting. The laser light socket bulb 110 may be constructed for use in indoor or outdoor lighting systems. The laser light socket bulb 110 may be constructed to fit standard medium based light sockets or their equivalents. The installation of decorative laser lighting by using the laser light socket bulb 110 is as simple as screwing or inserting a light bulb into a lighting socket by hand. In addition the light socket may revert to its original use at a later time simply by unscrewing the laser light socket bulb and screwing the original light bulb back in.

The lack of a power supply disposed in the power cord 104 is a useful feature as most laser lighting accessories typically include a power supply in the power cord. This hinders the universality of existing lighting fixtures as to accommodate a laser device a new power cord must be installed. Also, conventional laser lighting devices are not made for use with existing fixturing; the existing fixturing is typically removed and replaced.

An existing incandescent fixture 106 can be used without modification because of features that can be incorporated within the laser light socket bulb 110. The existing power cord does not need an external power inverter because there is a power supply inverter assembly (not shown) within the laser light socket bulb 110. The laser light socket bulb 110 has an AC socket base that can be compatible with existing conventional incandescent sockets. The shape of the laser light socket bulb 110 is determined by the shape of the housing, which can be made to encompass a similar envelop as the incandescent bulb it is replacing, thereby fitting within the incandescent fixture. Although the laser light socket bulb is shown as being used in an outdoor fixture (ground, wall or the like), the laser light socket bulb may also be used in indoor fixtures of various types that are designed to fit a standard lamp base, and bulb envelope that are compatible with a given laser light socket bulb.

Figure 2:
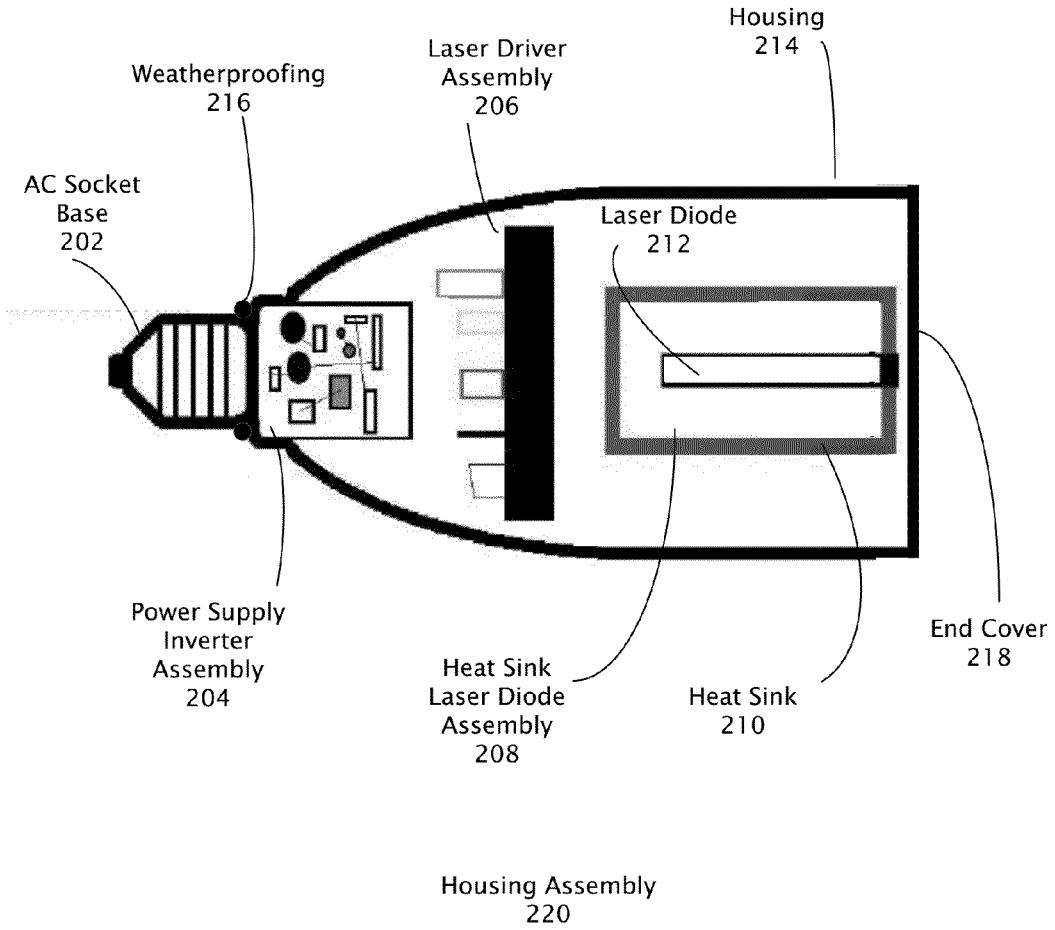
FIG. 2 shows a housing assembly for a laser light socket bulb.

FIG. 2 shows a housing assembly 220 for a laser light socket bulb 110. The housing assembly 220 contains the electronic components and the AC socket base 202 at one end. A protective end cover 218 is optionally coupled at the second end.

The housing 214 may be of any suitable material or combination of materials, such as plastic, glass, metal (with proper safety measures taken into consideration), or the like. The housing may be sealed or unsealed as called for by intended use. Sealed housings may also be waterproofed to prevent the intrusion of moisture encountered in outdoor lighting, or swimming pool lighting. Typically, a medium base socket of the Edison type, such as the E27 designation or similar may be used.

The housing 214 may be fitted with an AC socket base 202 that is of a suitable type to mate with the light socket it is being used in. The base need not be the screw in type as other types of bases are available on incandescent lamps and light fixtures.

The electronics to power and drive the laser as well as the laser itself are inside the housing. Disposed within the interior of the housing of the laser light socket bulb are: 1) A conventional power supply inverter assembly 204 allowing the conversion of line voltage A/C power to D/C power of a suitable voltage, typically ranging from 3 to 18 Volts; 2) A conventional laser driver assembly 206 for any needed regulation or conditioning of the power along with the control circuit wiring; 3) At least one conventional laser diode or its equivalent 212 to produce the beam of coherent light. The laser diode 212 is thermally coupled to a heat sink 210 to dissipate the heat from the laser. The heat sink 210 may be constructed from shaped aluminum, copper, or any material with appropriate thermal conductivity properties. The heat sink 210 and laser diode 212 are coupled to form the heat sink laser diode assembly 208.

1) The power supply inverter assembly 204 is conventionally constructed and has its AC input electrically coupled to an AC light socket base 202 which is attached at one end of the housing. The power supply inverter assembly 204 converts line voltage A/C power, typically 110-120 volts A/C to D/C power of the required voltage, typically ranging from 3 to 18 volts of power either through linear, switched power supply, or equivalent circuitry. DC Output power from the power supply inverter assembly 204 may be 6 VDC or equivalent as needed to drive the laser driver electronics and/or the laser diode. The power supply inverter assembly 204 location in the housing is advantageous due to the power being converted within the laser light socket bulb 110 and not the more typical application of the power inverter being located on an external power cord.

2) A laser driver assembly 206 for the regulation of the power along with control wiring is electrically coupled to the DC output from the power supply inverter assembly 204. The laser driver assembly 206 supplies power to the laser diode 212 and may also control power application to the laser diode 212, as well as provide electronic control of the laser diode 212, producing decorative lighting effects, such as turning the laser diode on and off, or firing multiple laser diodes of various colors in a predetermined or random sequence, and thermal shutdown or protection circuitry and the like.

3) The laser diode 212 produces the beam of light and may be thermally coupled to a heat sink 210 to dissipate the heat produced by the laser. The laser diode 212 may be a single or multiple devices that produce one or more wavelengths of typically coherent light either at the same time, or at differing times, typically as controlled by the circuit in the laser driver assembly 206. The heat sink 210 may optionally be thermally coupled to the housing 214 to help dissipate heat. The heat sink 210 may offer physical support to the laser diode or laser diodes, or optionally the housing may integrate a heat sink into its construction. The laser diode 212 is thermally coupled to the heat sink 210, creating a heat sink laser diode assembly 208. The heat sink may also be coupled additionally to the laser driver assembly 206 and/or the power inverter assembly 204 for additional heat dissipation.

The housing assembly 220 of the laser light socket bulb may have optional protective features included, especially when provided for outdoor use. These may include optional features such as a waterproofing sealant 216 where the AC socket base 202 attaches to the housing 214. The waterproofing 216 aids to prevent water, moisture, and dust infiltration into the housing assembly 220. Additionally, a protective end cover 218 may be provided at the opposite end of the housing assembly 220 to protect the electronic components from mechanical damage, or water, moisture, or dust infiltration. The protective end cover 218 may be constructed of glass, plastic, or other transparent material and may be attached to the housing 214 using thermal welding, screw threads, snaps glue, or the like. Alternatively the end cover may be an integral part of the housing with the housing being formed around the previously mentioned electronics.

Figure 3:
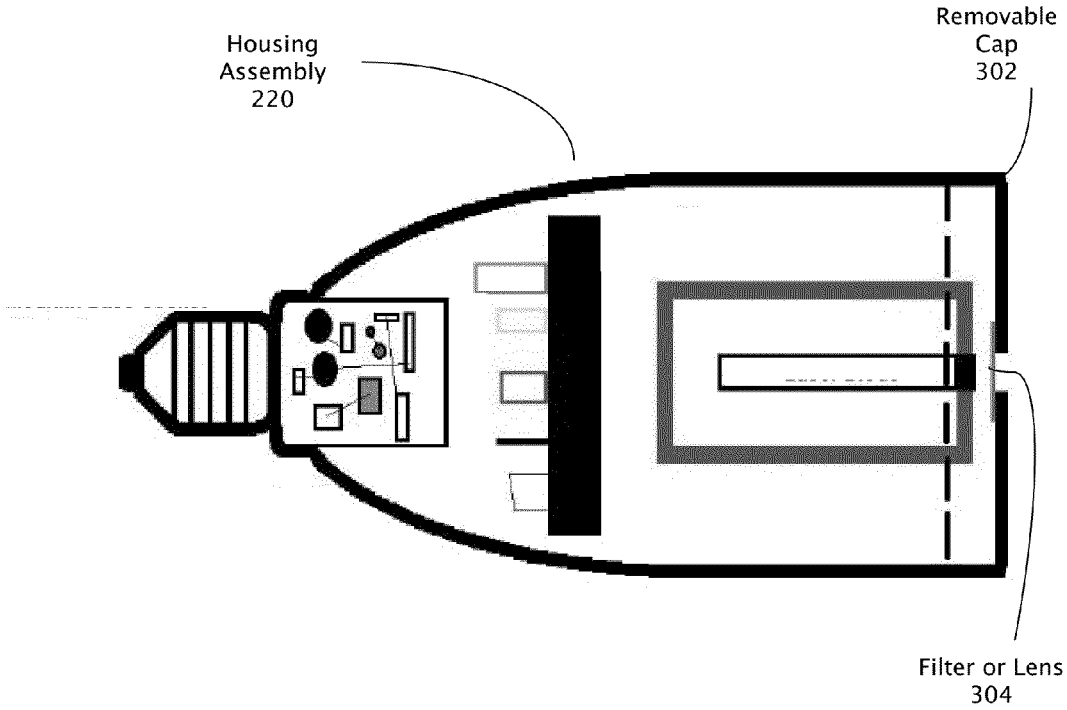
FIG. 3 shows a laser light socket bulb with a removable cap.

FIG. 3 shows a housing assembly 220 for a laser light socket bulb 310 with a removable cap 302. The laser light socket bulb 310 includes a removable cap 302 to further protect the components within the laser light socket bulb 310, and allow for interchangeable or fixed decorative features, such as lenses, gratings, and filters to provide decorative lighting effects desired for different holidays, seasons, or the like. The removable cap 302 may be constructed from the same materials as the housing 216 or of any other suitable material, such as such as plastic, glass, metal, or the like, or a combination of materials.

The removable cap 302 may couple to the housing assembly 220 via threads mating with corresponding threads on the housing 216. The threads may be molded into the housing 216 and the removable cap 302, or may be machined. Other methods to removably attach the cap 302 to the housing assembly 220 may be used, such as friction, snap attachments, or the like.

The removable cap 214 may contain lenses, filters, apertures, or other devices 304 of different sizes and shapes to create the desired decorative lighting effects. The device may be disposed in the path of a laser beam emitting from the housing, so that laser light passes through, and is changed by the device. The devices such as lenses, filters, apertures, or other features 304 may be constructed of plastic, glass, or other suitable materials. Additionally the removable cap may be twisted or rotated to aid in positioning or aligning an image produced.

Filters and lenses 304 may be within the housing to control and enhance the light from the laser diode 212 as shown for the laser light socket bulb 310. The decorative lighting effects that may be provided in the laser light socket bulb 310 are that it may be constructed to convert a single laser light beam into multiple, scattered individual specs, bits, or dots of light, also known as diffracted laser light. Typically, the light being divided is of one wavelength, or color, as is inherent with laser light. However, white laser light can be envisioned by the use of a suitable laser source and a grating or other optic device suitably constructed so that when the light is broken up into bits, it remains as uniform white dots and does not show fringing or rainbow effects at the edges.

Figure 4:
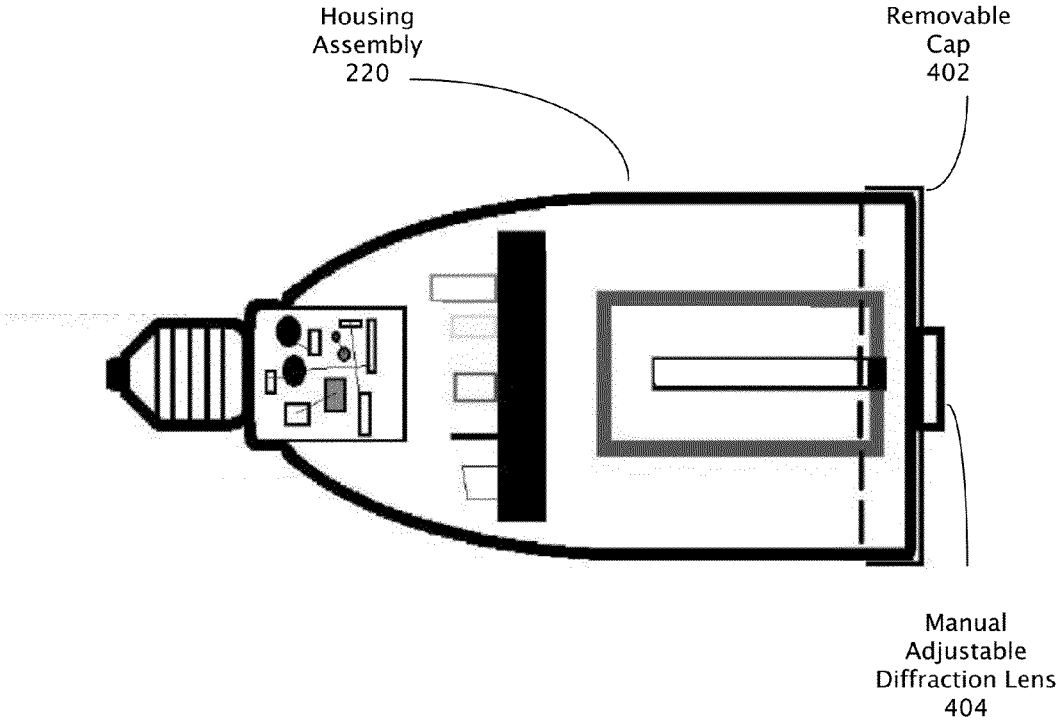
FIG. 4 shows a laser light socket bulb with a manual adjustable diffraction lens.

FIG. 4 shows a laser light socket bulb with a manual adjustable diffraction lens. The laser light socket bulb 410 is shown with an optional manual adjustable diffraction lens 404 attached to a removable cap 402. The laser light socket bulb 410 may include an adjustable diffraction lens 404, which may be supplied as a removable or integral threaded cap, to create multiple variations of light sizes and positions typically through the use of a diffraction grating, a pattern cut into the adjustable diffraction lens 404, or other decorative devices.

The manual adjustable diffraction lens 404 provides image control and includes either fixed or interchangeable transparencies, diffraction gratings, or the like to convert a single laser beam into multiple, scattered individual specs of light. This is also known as diffraction. The manual adjustable diffraction lens 404 may be rotated about the longitudinal axis of the laser light socket bulb 410 to create multiple variations of light sizes and positions, depending on the position of the manual adjustable diffraction lens 404.

The locations and sizes of the manual adjustable diffraction lens 404 can be varied. As the manual adjustable diffraction lens 404 is rotated, the specs of light configure and form different patterns. The manual adjustable diffraction lens 404 may be fixed, continuously variable, or have detents provided to guide the dial into particular locations. The manual adjustable diffraction lens 404 may be removably attached externally to the removable cap 402, or may be fixedly attached to the removable cap 402. The manual adjustable diffraction lens 404 can be manually controlled, without the use of any motors. Alternatively, the manual adjustable diffraction lens 404 may be controlled by a motor. The laser light socket bulb 410 is suitable for both indoor and outdoor use.

Figure 5:
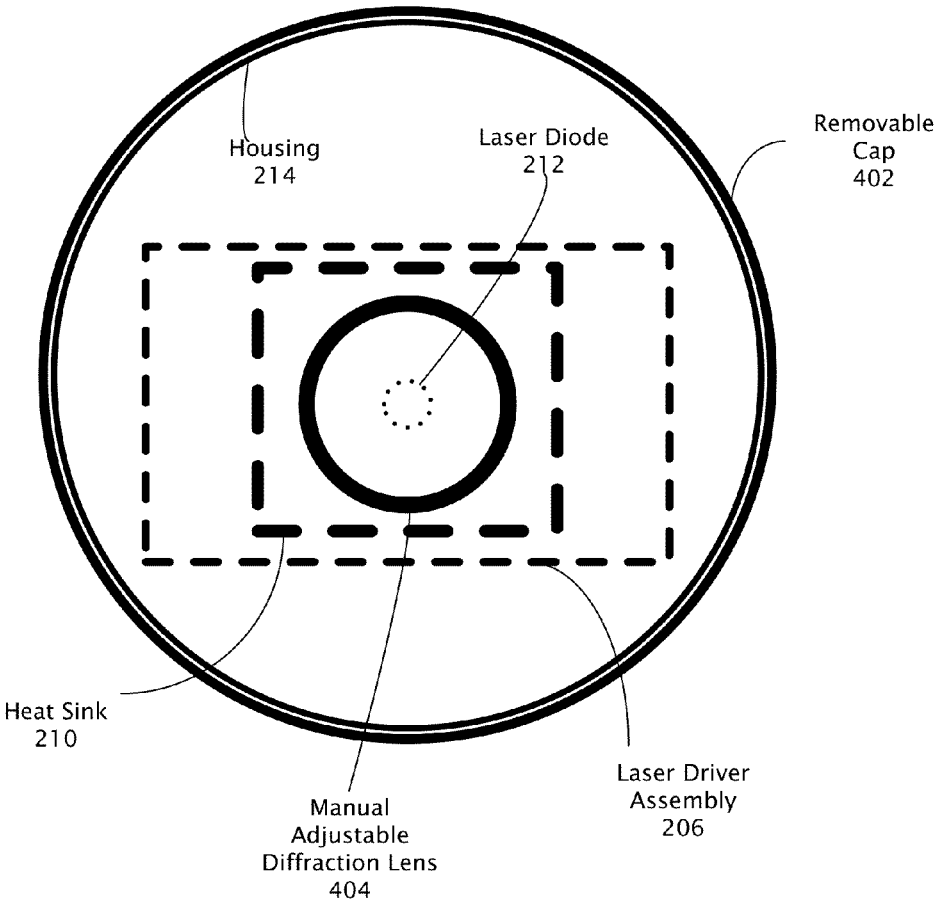
FIG. 5 shows an end view of a laser light socket bulb.

FIG. 5 shows an end view of a laser light socket bulb 510. The components in the laser light socket bulb 510 may be aligned somewhat coaxially. This configuration can facilitates manufacture in that subassemblies may be constructed outside the housing 216 and later installed into the housing 216, creating the housing assembly 220. The somewhat coaxial alignment also allows placement of the electronic components into a variety of housing 216 shapes and sizes.

Figure 6:
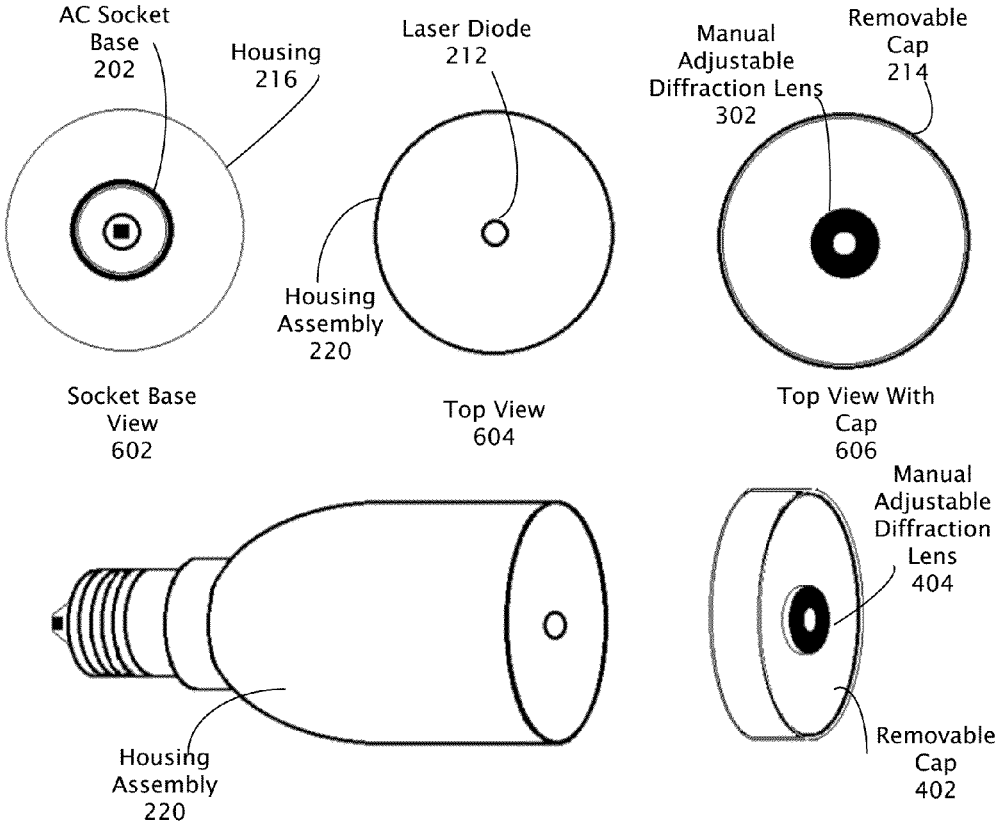
FIG. 6 shows various views of a laser light socket bulb and cap.

FIG. 6 shows various views of a laser light socket bulb and removable cap. View 602 shows an end on view of the AC socket base 202. A standard Edison-type socket is shown; however, any conventional incandescent light socket, such as push in, bayonet, or others may be provided depending upon the standard lamp fixture the laser light socket bulb will be used with.

View 604 shows a top view of the housing assembly 220. The light emitting end of the laser diode is visible through the optional protective end cover 218.

View 606 shows the top view of the laser light socket bulb 410 with a removable cap 402 installed. The removable cap 402 shown in this view includes a manual adjustable diffraction lens 404. The manual adjustable diffraction lens 404 is interchangeable with other lenses, with or without diffraction patterns, including clear or colored transparent lenses.

View 608 is a perspective view of a laser light socket bulb housing assembly 220 with a removable cap 402 with a manual adjustable diffraction lens 404. It is apparent that the laser light socket bulb may be provided with a multitude of removable caps 402, which can provide a variety of decorative lighting effects. The various views in this figures show outlines and apertures that are round in shape. In alternative examples different shapes such as square, oval, hexagonal or the like may be provided.

Figure 7:
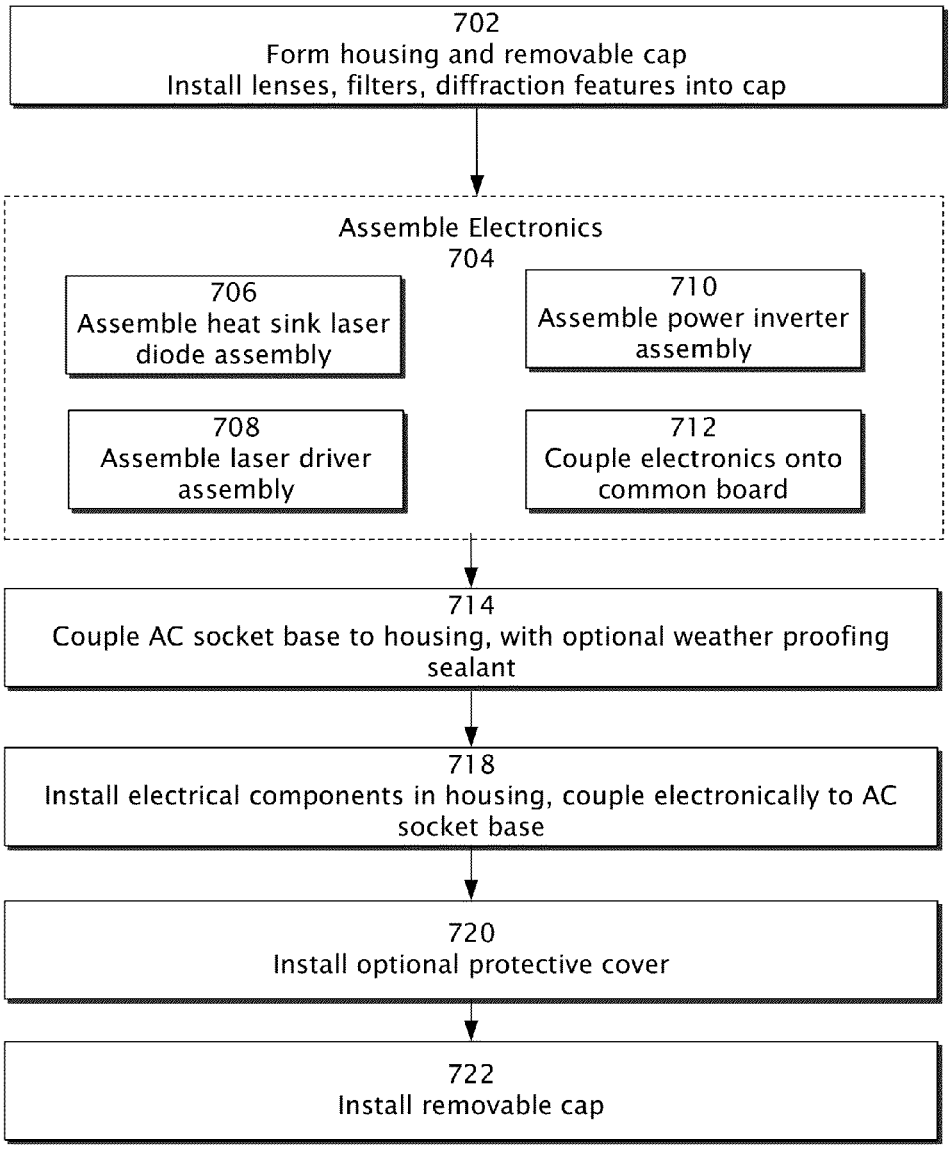
FIG. 7 is a block diagram showing a method of assembling a laser light socket bulb.

FIG. 7 is a block diagram showing a method of assembling a laser light socket bulb. The housing (216 of FIG. 2) and removable cap (214 of FIG. 2) are formed 702 into shapes comparable to the incandescent bulb they are to replace, of sufficient size to contain the laser light socket bulb components. The housing and cap may be made from the same or differing materials, such as glass, plastic, metal, or the like.

Included in this block may be the incorporation of the method for attaching the removable cap to the housing, such as molded or machined screw threads, snap, or the like. Also included in this block is construction of any decorative lighting features such as lenses, filters, or diffraction effects in the removable cap.

In block 704, the electronic components are assembled. This includes sub-block 706, coupling the heat sink to the laser diode creating the heat sink laser diode assembly. This block allows for facilitation of the disposition of heat from the laser diode through the heat sink and also may provide physical support of the laser diode. Sub-block 708 is assembly of the laser driver assembly (206 of FIG. 2). This may include providing appropriate circuitry to drive the laser diode (212 of FIG. 2), including turning the laser diode (212 of FIG. 2) on and off, firing multiple laser diodes (212 of FIG. 2) simultaneously or sequentially, as well as providing safety features and thermal protection circuitry. Sub-block 710 provides for assembly of the power inverter assembly (204 of FIG. 2). The power inverter assembly (204 of FIG. 2) takes line voltage A/C power and converts it to an appropriate voltage D/C power for powering the laser diode (212 of FIG. 2). Once assembled, the heat sink laser diode assembly (208 of FIG. 2), the laser driver assembly (206 of FIG. 2), and the power inverter assembly (204 of FIG. 2) may be coupled electronically on a common board in sub-block 712. Alternatively, various components may be assembles on separate boards as desired and coupled to other boards by soldered connections or the equivalent. Also in alternative examples point to point wiring may be utilized.

The AC socket base (202 of FIG. 2) is coupled to the housing. Optionally, a sealant to provide weatherproofing (216 of FIG. 2) may be used in this block. The weatherproofing (216 of FIG. 2) may be silicone, latex, or any other material that prevents water, moisture, dust, and the like from entering the housing (214 of FIG. 2) and coming in contact with the electronic components. In block 718, the electronics, on their common board, are placed within the housing (214 of FIG. 2) and electronically coupled to the AC socket base (202 of FIG. 2). Block 720 provides for installation of an optional protective end cover (218 of FIG. 2) over the open end of the housing assembly (220 of FIG. 2). This cover may be plastic, glass, or any appropriate material. The final block 722 in the construction is to install the removable cap created in block 702.

Those skilled in the art will realize that the process sequences described above may be equivalently performed in any order to achieve a desired result. Also, sub-processes may typically be omitted as desired without taking away from the overall functionality of the processes described above.

Figure 8:
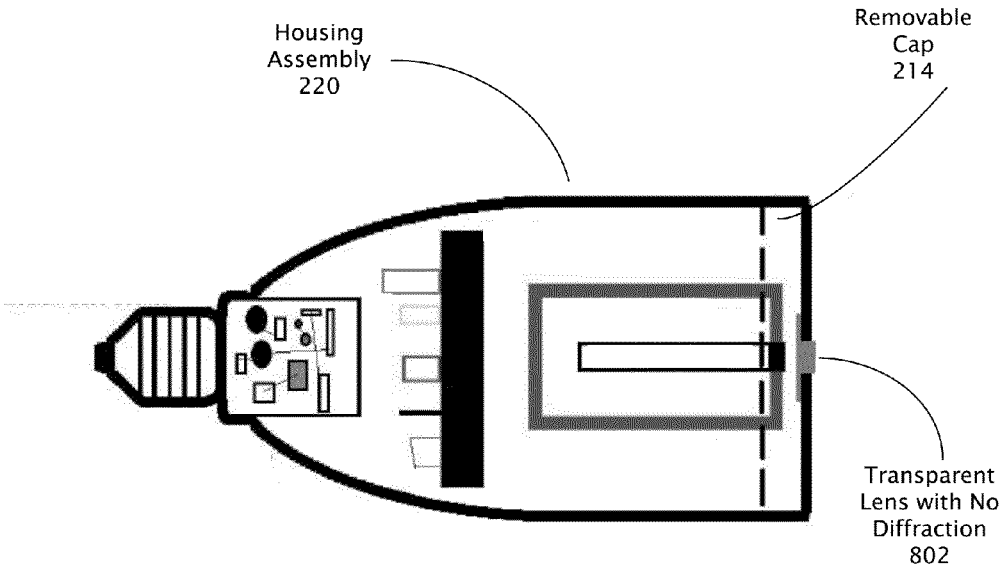
FIG. 8 shows a laser light socket bulb with a removable cap having a transparent lens.

FIG. 8 shows a laser light socket bulb 810 with a removable cap 214 having a transparent lens with no diffraction 802. The transparent lens with no diffraction 802 may be of any color. Accordingly, this laser light socket bulb 810 has no diffraction, and such an example would produce a single laser beam, like a laser pointer except in this case the single beam is produced by a laser light socket bulb 810.

Figure 9:
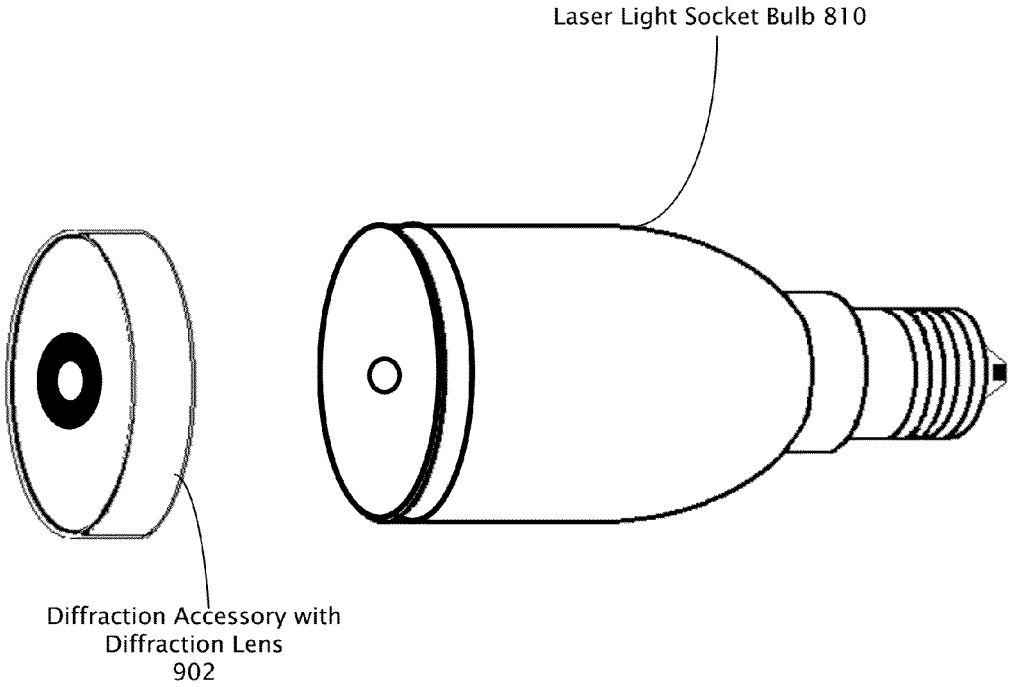
FIG. 9 shows a laser light socket bulb with an diffraction accessory containing a diffraction lens.

FIG. 9 shows a laser light socket bulb 810 with an diffraction accessory with diffraction lens 902. The diffraction accessory with diffraction lens 902 may be placed onto a laser light socket bulb 810 to provide decorative lighting effects. without diffraction may be coupled to a separate diffraction accessory containing diffraction lens 902, which could then allow diffraction of the laser light radiating from the laser light socket bulb 810. The diffraction accessory may be fixed or it may rotate about the longitudinal axis of the laser light socket bulb 810 to provide a variety of decorative lighting effects. It is also possible to create a variety of decorative lighting effects with a multitude of diffraction accessories with differing diffraction lenses 902 interchangeable with the same laser light socket bulb 810.

Figure 10:
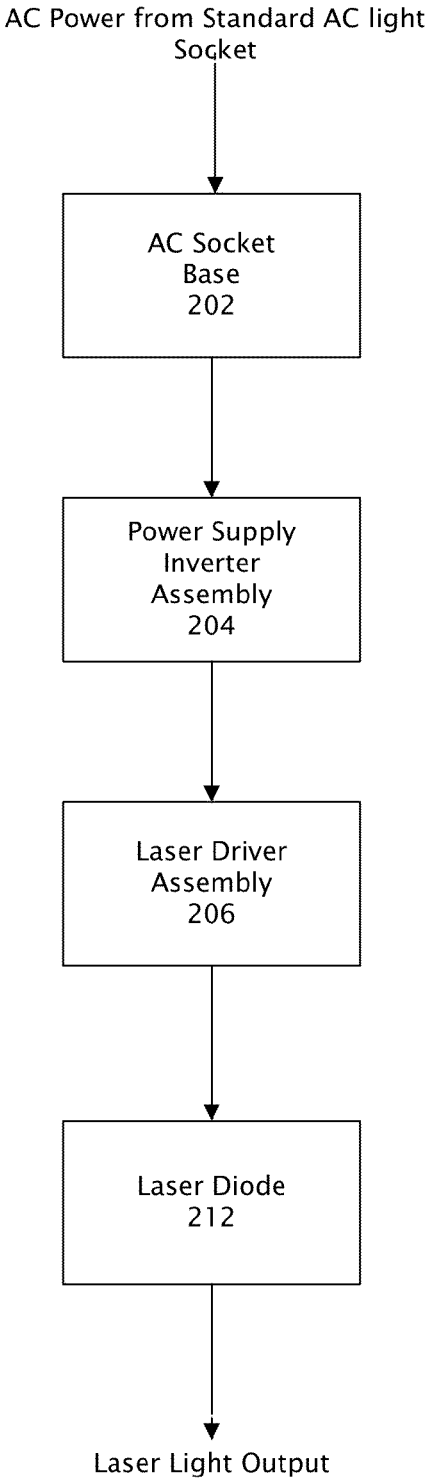
FIG. 10 is a block diagram of the electronics contained in the laser light socket bulb.

FIG. 10 is a block diagram of the electronics 1002 contained in the laser light socket bulb. The AC socket base 201 supplies AC power from a conventional light fixture to conventionally constructed laser power supply 204, and laser driver electronics 206. The laser driver output is in turn coupled to the laser 212, which is typically a conventional laser diode. The electronics 204, 206, 212, may be disposed on separate printed wiring boards ("boards" or "PWBs") or on one or more common as space and construction parameters allow so that the electronics 1002 may fit into the housing (214 of FIG. 2).

The invention claimed is:

1. An illumination system comprising:

a conventional incandescent lighting system having an incandescent light fixture; and a laser light socket bulb disposed in the incandescent light fixture, the laser light socket bulb including:

a housing having an envelope size compatible with an incandescent bulb of the incandescent light fixture;

a standard AC socket base to fit the incandescent light fixture;

a power supply inverter assembly internal to the housing;

a laser driver assembly coupled to the power supply inverter, and internal to the housing providing electronics for controlling a laser diode, that producing decorative lighting effects; and a heat sink laser diode assembly internal to the housing and coupled to the laser driver assembly.

2. The illumination system of claim 1 in which the standard AC socket is an Edison type base.

3. The illumination system of claim 1 further comprising a removable cap including a device disposed in the path of a laser beam emitting from the housing.

4. The illumination system of claim 2 in which the device is a lens.

5. The illumination system of claim 2 in which the device is a diffraction grating.

6. The illumination system of claim 2 in which the device is a filter.

7. A laser light socket bulb, comprising;

a housing having an envelope size compatible with an incandescent bulb of the incandescent light fixture;

a standard AC socket base to fit the incandescent light fixture;

a power supply and laser driver electronics internal to the housing; and a laser internal to the housing and coupled to the power supply and laser driver electronics, and where the driver electronics control the laser producing decorative lighting effects.

8. The laser light socket bulb of claim 7 further comprising a heat sink disposed in the housing and thermally coupled to the laser diode.

9. The laser light socket bulb of claim 7 further comprising a diffraction grating disposed the path of light emitting from the laser.

10. The laser light socket bulb of claim 7 in which the laser is a laser diode.

11. The laser light socket bulb of claim 7 in which the laser light socket bulb has a form factor of a standard incandescent bulb allowing the laser light socket bulb to replace the standard incandescent bulb in a fixture designed to accept the standard incandescent bulb.

12. The laser light socket bulb of claim 7 further comprising an end cap for inserting a device for creating visual effects in a path a laser beam emitting from the laser light socket bulb.

13. The laser light socket bulb of claim 12 in which the device is a filter.

14. The laser light socket bulb of claim 12 in which the device is a lens.

15. The laser light socket bulb of claim 12 in which the end cap is removable.

16. The laser light socket bulb of claim 15 in which the device is a manually adjustable diffraction lens.

17. The laser light socket bulb of claim 15 in which the device is a transparent lens.

18. A method of making a laser light socket bulb comprising:

forming a housing with a first end and a second end, forming a removable cap, assembling a heat sink laser diode assembly having a laser diode;

assembling a laser driver and inverter;

coupling the laser diode, laser driver for controlling the laser light produced, and providing thermal protection circuitry, the power inverter together electrically;

coupling an AC socket base onto the first end of said housing, creating a socket base-housing junction forming an electronics unit;

inserting the electronics unit into the housing;

coupling the electronic components to the AC socket base; and installing the removable cap to the second end of the housing, where the removable cap includes the ability to selectabally install gratings or filters to provide user selectable lighting effects.

19. The method of making a laser light socket bulb of claim 18 further comprising applying a weatherproofing sealant to said AC socket base-housing junction.

20. The method of making a laser light socket bulb of claim 18 further comprising attaching a protective cover to the second end of the housing.

* * * * *